US009126233B2

(12) United States Patent
Sierens et al.

(10) Patent No.: US 9,126,233 B2
(45) Date of Patent: Sep. 8, 2015

(54) CYLINDER EXCHANGE DEVICE AND METHOD FOR SOLID MATERIAL PROCESSOR

(75) Inventors: Marcel Sierens, Somerset (CA); Richard Gergatz, Stonewall (CA)

(73) Assignee: Arrowcorp Inc., Winnipeg, Manitoba (CA)

( * ) Notice: Subject to any disclaimer, the term of this patent is extended or adjusted under 35 U.S.C. 154(b) by 241 days.

(21) Appl. No.: 13/512,223

(22) PCT Filed: Nov. 25, 2010

(86) PCT No.: PCT/CA2010/001875

§ 371 (c)(1), (2), (4) Date: May 25, 2012

(87) PCT Pub. No.: WO2011/063519

PCT Pub. Date: Jun. 3, 2011

(65) Prior Publication Data

US 2012/0285868 A1 Nov. 15, 2012

Related U.S. Application Data

(60) Provisional application No. 61/264,718, filed on Nov. 27, 2009.

(51) Int. Cl.
*B07B 1/22* (2006.01)
*B07B 1/24* (2006.01)

(52) U.S. Cl.
CPC ... *B07B 1/24* (2013.01); *B07B 1/22* (2013.01); *Y10T 29/49815* (2015.01)

(58) Field of Classification Search
CPC ..... B07B 1/22; B07B 1/18; B07B 1/42; B07B 1/40; B07B 1/46; B07B 1/48; A01F 12/444; B06B 1/166; F24B 15/007; A47J 43/22; D21D 5/16; B01D 33/0376
USPC ..... 209/288, 363, 364, 370, 371, 410–413
See application file for complete search history.

(56) References Cited

U.S. PATENT DOCUMENTS 1,841,299 A 1/1932 Rife
2,249,109 A 7/1941 Botimer
(Continued)

FOREIGN PATENT DOCUMENTS

EP 603816 A1 6/1994
EP 0 739 657 10/1996
(Continued)

OTHER PUBLICATIONS

Canadian Intellectual Property Office, International Search Report, Mar. 9, 2011, PCT/CA2010/001875 (Arrowcorp Inc.).

*Primary Examiner* — Thomas Morrison

(57) ABSTRACT

Grading machines include machines for sorting and/or separation of solid granular or particulate materials according to the physical parameters of the component particles. Some grading machines employ a grading cylinder for retaining the material, the grading cylinder being driven by the machine to rotate about its axis. Disclosed herein are devices for easy insertion, removal, or replacement of grading cylinders from such grading machines. Also disclosed are methods for cylinder removal from a grading machine, e.g. for maintenance or cylinder replacement. The devices and methods disclosed permit stacking of grading machines in a factory or industrial setting.

15 Claims, 8 Drawing Sheets

(56) References Cited

U.S. PATENT DOCUMENTS

| | | | | | |
|---|---|---|---|---|---|
| 2,985,302 | A | * | 5/1961 | Brands | 209/235 |
| 3,612,273 | A | | 10/1971 | Pritchett | |
| 3,661,257 | A | | 5/1972 | Hall et al. | |
| 4,193,874 | A | * | 3/1980 | Gerteis | 210/232 |
| 4,269,711 | A | * | 5/1981 | Gerteis | 210/232 |
| 4,469,230 | A | | 9/1984 | Gorlitz et al. | |
| 4,785,761 | A | | 11/1988 | Greenbank | |
| 4,927,528 | A | | 5/1990 | Doppstadt | |
| 4,944,874 | A | * | 7/1990 | Kobayashi et al. | 209/288 |
| 5,306,423 | A | * | 4/1994 | Hultsch | 210/232 |
| 5,348,162 | A | | 9/1994 | Wroblewski | |
| 5,373,948 | A | | 12/1994 | Nagaki | |
| 5,398,814 | A | | 3/1995 | Sime | |
| 5,860,531 | A | | 1/1999 | Satoru et al. | |
| 5,921,400 | A | * | 7/1999 | Judd | 209/287 |
| 6,253,928 | B1 | | 7/2001 | Weber | |
| 2004/0251333 | A1 | | 12/2004 | Arvidson et al. | |
| 2007/0084760 | A1 | * | 4/2007 | Tse | 209/288 |

FOREIGN PATENT DOCUMENTS

| | | |
|---|---|---|
| FR | 800162 | 4/1936 |
| FR | 2 651 694 | 3/1991 |
| GB | 200000 | 7/1923 |
| GB | 1571678 | 7/1980 |
| WO | WO 88/03444 | 5/1988 |
| WO | WO 90/08597 | 8/1990 |
| WO | WO 92/12808 | 8/1992 |
| WO | WO 99/65619 | 12/1999 |
| WO | WO 03/011483 A1 | 11/2003 |
| WO | WO 2005/014186 | 2/2005 |

* cited by examiner

CYLINDER EXCHANGE DEVICE AND METHOD FOR SOLID MATERIAL PROCESSOR

CROSS-REFERENCE TO RELATED APPLICATION

This application is a U.S. national phase pursuant to 35 U.S.C. §371 of PCT application PCT/CA2010/001875 filed Nov. 25, 2010, which claims priority to provisional U.S. application 61/264,718 filed Nov. 27, 2009, each of which is incorporated by reference in their entirety.

FIELD OF THE INVENTION

The invention relates to the field of the processing of solid particulate or solid granular materials. In particular, the invention relates to machinery used to sort or separate solid materials for example to be processed into food, such as grains and beans.

BACKGROUND TO THE INVENTION

Various machines are known for the processing and separation of solid granular or solid particulate materials. Such sorting devices and graders often include one or more hollow cylinders, each of which can be rotated about its central axis by some form of drive means. The hollow cylinder includes a means for input of the granular or particulate material, and some other means to collect different portions of the material that have been sorted or graded according to their size, (e.g. length, width or thickness), or other physical characteristics. The input and output means, optionally together with other components, may permit either batch or continuous processing of the particulate material. Depending upon their intended use and the materials to be processed, the machines use different types of cylinders, each with carefully designed features that facilitate the sorting process. The configuration of the cylinder, combined with the forces generated by rotation of the cylinder, and other rotating components within the cylinder, determine the way in which the material is processed or sorted.

For example, some cylinders include an array of small perforations about the main curved surface of the cylinder, the perforations having sufficient size to permit narrower particles to pass through, but of insufficient size to permit wider particles to pass through. In this way, rotation of the cylinder about its central axis causes particles retained within the cylinder to be thrown about and against the internal walls of the cylinder. Narrower particles exit the cylinder through the perforations assisted by the centrifugal force of the rotating cylinder, whereas wider particles are retained within the cylinder for later collection. Often, perforated cylinders are used to separate granular products according to the width and/or thickness of the particles. Optionally, an agitator may be mounted co-axially within the cylinder to assist in the movement of the granular material about the inside of the cylinder.

Other examples of cylinder types include those with indentations (rather than perforations) about the internal surfaces of the cylinder, again to cause material within the cylinder to be separated into distinct portions. Often indented cylinders are employed within indent length grading machines (sometimes known as triers) to separate granular products according to the length of the particles. The indentations on the internal curved surface of the cylinder are sized such that particles having a length similar to or less than the length of the indentations are retained within the indentations and lifted as the cylinder rotates. Eventually, as the cylinder continues to rotate, the lifted particles fall from the indentations under gravity, to be caught by a trough typically mounted within a central region of the cylinder. A screw conveyor or auger may also be associated with the trough to assist in movement of the liftings portion of the material caught by the trough. In contrast, the tailings portion retained in the outer or lower regions of the cylinder may be removed by another outlet.

U.S. Pat. Nos. 3,612,273, 4,469,230, and 6,253,928, which are incorporated herein by reference, provide just three examples of prior patent documents that disclose such sorting machines and devices.

However, grading machines are often large and difficult to service. The grading cylinders may be difficult to replace due to their size and weight, or because of general access to the cylinder(s) in the grading machine. Typically, a grading cylinder must be lifted bodily out of a grading machine for service, or for insertion of a different type of cylinder into the grading machine. This is illustrated with reference to FIG. 1, derived from FIG. 6 of U.S. Pat. No. 4,469,230, which is incorporated herein by reference. Here it may be observed that a user of the machine wishing to replace sorting cylinder 11 must physically lift the cylinder from the machine via an opening or space alongside the cylinder. Not only does this require significant effort by the user, but clear access must be provided for cylinder removal and/or replacement. This may be difficult in an industrial setting, such as a busy factory floor. In other examples known in the art, access to the cylinder may be provided from above, such that the cylinder must be hoisted up and out of the machine.

At times due to the size of the grading cylinders or the configuration of the grading machine, the grading cylinders must be dismantled within a grading machine prior to their removal. For example, at times it may be desirable to retain a specific screw conveyor or agitator in position within a grading machine, and replace only the grading cylinder either with one of different properties, or for servicing of the machine. To this end, some grading machines require the use of "split cylinders" comprising two halves or several sections to be separated prior to cylinder removal. Such cylinders require re-assembly prior to their use in a grading machine, or re-assembly within the machine interior. Significant skill is required to ensure proper re-assembly of a split cylinder. Improper establishment of joints between the cylinder sections may result in poor rotation of the cylinder and damage to the cylinder or machine components.

Alternatively, other machines involve the use of whole cylinders that cannot be split or disassembled into separate sections. Typically, such cylinders must be removed from grading machines together with any components retained internal to the cylinders during operation (e.g. agitators, screw conveyors, troughs and the like).

Thus, whilst many machines and devices are known in the art for the sorting, grading or separation of solid granular or solid particulate materials, such machines and devices are often cumbersome and difficult to maintain and service. Often, the insertion and removal of cylinders, either for servicing or to change the configuration of the machine, can be very time consuming. There is a need in the art for versatile grading machines that permit quicker-changing of grading cylinders.

SUMMARY OF THE INVENTION

It is one object to provide a device for easy insertion, removal, or replacement of a grading cylinder into a grading machine, or a grading machine comprising such a device.

It is another object to provide a method for insertion, removal, or replacement of a grading cylinder into or out of a grading machine.

Certain exemplary embodiments provide a device for insertion or removal of a grading cylinder into or from a grading machine that includes drive means to drive rotation of the grading cylinder about its central axis, the device comprising:

(a) drive selection means to selectively engage the drive means with, or selectively disengage the drive means from, the grading cylinder;

(b) a retainer to hold any cylinder away from the drive means when disengaged therefrom, the retainer comprising at least one roller and/or slider for axial movement of any cylinder held by the retainer between a drive position adjacent the drive means, and a change position suitable for insertion or removal of the cylinder from the machine.

Certain other exemplary embodiments provide a machine for use with a grading cylinder for separation of solid granular or particulate materials according to physical parameters of the component granules or particles, the machine comprising:

a device as described herein;

a drive means to drive rotation of a grading cylinder about its main axis when retained by the machine in a drive position.

Certain other exemplary embodiments include a facility for separation of solid granular or particulate materials according to physical parameters of the component granules or particles, the facility comprising:

a plurality of machines as described herein, at least two of the machines being stacked one on top of the other, or juxtaposed one beside the other;

whereby each grading cylinder is insertable into or removable from each stacked machine by axially rolling or sliding each grading cylinder to or from the drive position.

Certain other exemplary embodiments provide a method for removal of a grading cylinder from a grading machine as described herein, the method comprising the steps of:

a. disengaging, by way of the drive selection means, the cylinder from the drive means;

b. holding, by way of the retainer, the cylinder away from the drive means;

c. axially rolling and or sliding, by way of the rollers and/or sliders, the cylinder to said change position.

DEFINITIONS

Figure 1:
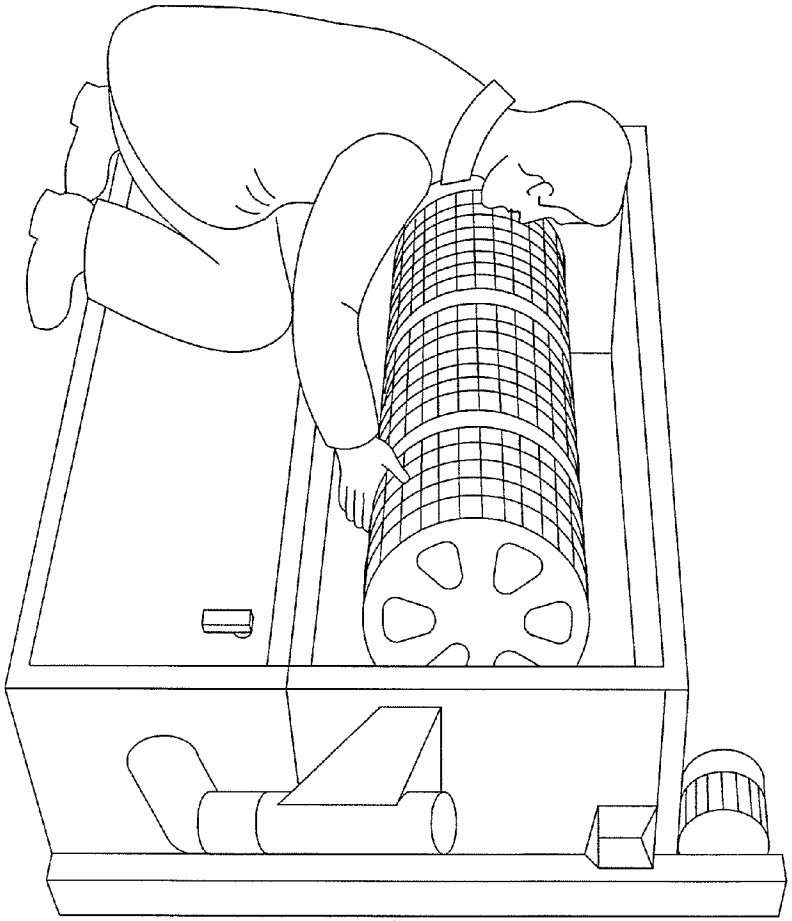
(PRIOR ART) FIG. 1
FIG. 1 illustrates a grading machine and grading cylinder of the prior art, wherein the grading cylinder is being removed from the grading machine.

Axial movement: refers to a general direction of movement for a grading cylinder when being inserted into or removed from a grading machine as described herein, facilitated by a device as described herein. Axial movement encompasses any movement of the cylinder that achieves at least some form of axial displacement between the start and end points of the movement, in accordance with the main or central axis of the cylinder. Thus, if the cylinder is held by its ends and lifted directly up, or lowered directly down, or if the cylinder is freely pulled or pushed with equal force on each end of the cylinder, then no axial movement would be expected to occur. However, any other form of movement is encompassed by the expression axial movement. An axial movement of the cylinder may be a movement substantially parallel or in line with the main or central axis of the cylinder, or alternatively may be a movement along a curvilinear path wherein at least some form of axial displacement is achieved. Typically, an axial displacement of the cylinder occurs by way of a device of the present invention during insertion or removal of the cylinder from a grading machine.

Axial rotation: refers to any rotation of a cylinder, auger, or similar component generally about its central or main axis, which typically defines an axis of rotational symmetry for the cylinder, auger, or similar component. Typically, the rotation is caused by a drive means which provides power to drive the rotation of the cylinder or auger.

Cradle or frame: refers to any device or structure that provides, either through direct contact or by associated rollers or sliders, support to hold a grading cylinder away from a drive means such as powered drive wheels, so that the grading cylinder is in a position ready to be rolled or slid by axial movement away from the drive means to another position better suited for removal from a grading machine. Further, the cradle or frame may also hold a cylinder to be inserted into a grading machine so that it can be rolled or slid by axial movement or displacement into a drive position ready to contact the drive means, such as drive wheels. The cradle or frame may take any shape or configuration to contact the cylinder in at least one position, preferably at least 2 positions. The frame preferably includes rollers or sliders either to achieve rolling or sliding of the frame relative to other components of a grading machine, or to contact the cylinder directly such that the cylinder may be rolled or slid along or over the rollers or sliders thereby to achieve the axial movement.

Device: refers in general to a device of the present invention, which at least comprises a drive selection means and a retainer as described herein.

Drive selection means: refers to any component or components that co-operate to cause the drive means to be either in contact with a grading cylinder to drive powered rotation thereof, or to provide physical separation between the grading cylinder an associated drive means. In a simple form, the drive selection means may include, for example, a linkage to pull drive wheels away from contact with the cylinder, or to push the drive wheels back into contact with the cylinder. In another example, the drive selection means may comprise any components to selectively lift or push the cylinder away from drive wheels so that contact between the cylinder and the drive wheels is selectively broken. In other embodiments, the drive selection means may be any means to selectively cause operability or inoperability of the drive means, so that even if a user requests power from the drive means in an inoperable mode, the power of the drive means will not be successfully transferred to the cylinder. Thus the drive selection means may include any system of belts, chains, cogged wheels, or the like wherein the power transfer by the belts, cogged wheels or the like may be selectively modulated.

Grading cylinder: refers to any form of cylinder that is known in the art for the processing, separation, or sorting of granular or particulate materials. Such cylinders include but are not limited to those with a plurality of perforations or indentations suitable to facilitate processing of the materials. The cylinders are typically of uniform cross-section, but may alternatively include those with non-uniform cross-section, for example with a varying diameter along the length of the cylinder. Many different types of cylinders are known in the art, each designed for a specific application to process a material have specific characteristics, such as for example granular particles of a predetermined size or weight, such as grains, beans, nuts and the like. In selected examples the grading cylinder may comprise either a whole cylinder or a continuous tube with ends for example made of a metal such as steel or cast iron. In other examples the cylinder may be a "split cylinder" that can be dismantled into component segments or halves, which can be reassembled prior to use or insertion into a grading machine. Optionally, a grading cylinder may include one or more components retained within the curved main body of the cylinder to assist in material sorting or separation when the cylinder is used within a grading machine. The cylinder may therefore comprise an agitator, screw conveyor, collection trough, inlet, outlet or other components as an integral feature, such that removal or insertion of such a cylinder from a grading machine in accordance with the teachings herein further includes insertion or removal of any such additional cylinder components.

Granular or particulate material: refers to any material comprising particles, wherein the particles have an average diameter of from 0.1 to 10 cm. Such materials include both organic and inorganic materials. Preferably the materials are related to, or precursors of, foodstuff materials such as grains, seeds, nuts and the like.

Machine: refers to any form of grading machine as described herein that is suitable to receive and cause rotation of a grading cylinder as described herein. In selected embodiments the machine may include a grading cylinder, or a plurality of grading cylinders to be interchanged as required. Any machine disclosed herein may include a device as disclosed herein for facilitating cylinder insertion, removal or exchange, or alternatively may include means or components for controlling or specifying a speed and/or direction of rotation of an auger, agitator, or similar device relative to a cylinder arranged coaxially therewith.

Retainer: refers to any component or group of components that are capable of holding a grading cylinder so that it is supported separate from drive means such as drive wheels, belts, chains, cogged wheels or the like. The retainer may take any shape or configuration providing that the cylinder is retained or held for a transient or prolonged period of time, such that the cylinder may be rolled or slid in a direction so that axial displacement of the cylinder is achieved. The retainer may take the form of a cradle or frame as described herein, and may optionally include one or more rollers and or sliders, also as described herein, to facilitate the axial movement of the cylinder.

Roller: refers to any component or group of components each with at least one wheel-like element mounted for rotation, and another portion for mounting the roller to another portion of a retainer, or other component of a device or machine as described herein. Some rollers may take the configuration of a castor, although any form of roller will suffice in which the wheel-like portion is able to freely rotate such that another component may contact or rest upon the wheel-like portion, and roll along or over the roller. For example, a roller may permit a retainer or frame to roll over other portions of a machine (e.g. rails), such that any cylinder resting on or supported by the retainer can move in a direction at least partly in line with a main axis of the cylinder. Alternatively, rollers may be oriented in a generally upward direction such that the wheel-like portion of each roller is generally above the other portion that is mounted to the retainer or frame, wherein a cylinder may be positioned such that its curved surface generally rests upon the wheel-like portion, so that axial movement of the cylinder is achieved by rolling the cylinder over the roller with rotation of the wheel-like portion as the contacted, moving cylinder presses against it.

Slider: a slider has a configuration similar to a roller except that the wheel-like portion is effectively replaced by a slider portion, preferably of a low-friction material, such that movement of a surface (either a surface of a cylinder, or a surface of another portion of the device or machine) over the slider portion is facilitated by a low level of friction, thereby to achieve sliding rather than rolling of the cylinder or other component over the slider.

DETAILED DESCRIPTION OF THE PREFERRED EMBODIMENTS

The inventors have recognized a need to develop grading machines that permit rapid and easy cylinder access, with reduced need for large access areas. To this end, the inventors have developed a device that permits cylinder access, for easy or rapid insertion and removal of grading cylinders, in an entirely new way. In selected embodiments the devices permit cylinder insertion and removal from a grading machine by way of axial movement or axial displacement of the cylinder. In this way, the cylinder is easier to manhandle, and only a small access area is required for cylinder insertion and removal. Furthermore, by providing corresponding grading machines with "end-access" to the grading cylinders, multiple machines may be placed in juxtaposition or even stacked in a factory setting. This reduces the space required to operate a plurality of grading machines, and optionally product discharge from one grading machine may be fed easily and directly into an adjacent grading machine for further processing.

In just one example of industrial application, the grading machines described herein may be stacked one on top of another, and grading cylinders inserted rapidly into each of the stacked grading machines. Raw granular or particulate material fed into the top grading machine may be processed to remove a fraction of small particulate material, and then fed into the grading machine beneath the top grading machine to remove the next size of particulate material from the feed, and so on until only the largest particles are left in the discharge from the bottom grading machine. In this way, granular or particulate material may be rapidly separated according to particle size, yet the process requires only a small area of a factory floor.

Furthermore, the devices of the invention permit rapid replacement of grading cylinders, thus reducing the downtime of the grading machine, and increasing productivity. In selected embodiments, the devices may permit a grading cylinder to be replaced in less than ten or even perhaps less than three minutes. This contrasts significantly with grading machines of the prior art, which sometimes require 30-60 minutes on average for grading cylinder replacement. In selected embodiments, the invention permits insertion or removal of a grading cylinder from a grading machine without significant disruption or need for displacement of other components normally retained within the grading cylinder during operation, such as agitators, screw conveyors, liftings troughs and the like. If desired, such other components may be retained in position within the machine, and a whole grading cylinder removed or inserted as required.

Whilst the inventors have developed a device per se, the device will be explained and illustrated in the context of its use in the factory setting, as part of a grading machine. In one exemplary embodiment the device may facilitate insertion or removal of a grading cylinder into or from a grading machine that includes some form of drive means to drive rotation of the grading cylinder about its central axis. The drive means generally forms a component part of the grading machine, and may take any form suitable to cause rotation of the grading cylinder when positioned appropriately in the grading machine for operation. For example, the drive means may be a direct drive means, or an indirect drive means operatively connected to a motor by a belt or chain. In other embodiments the drive means may comprise drive wheels optionally connected by a drive shaft and driven by mechanical linkage to a motor, wherein the drive wheels contact directly a portion of the cylinder to drive rotation thereof. Such drive wheels typically have an axis of rotation oriented generally parallel and in alignment with the main axis of the cylinder when placed in the machine (see for example U.S. Pat. No. 4,469,320). Regardless, the device itself may be fitted to any grading or other type of sorting machine that employs any type (or multiple types that can be interchanged) of grading cylinder. The device may be incorporated into the grading machine upon manufacture thereof, or alternatively the devices may be retrofitted to already manufactured grading machines, either to replace or in addition to any cylinder insertion/removal devices that may already form part of the machines.

In certain exemplary embodiments the device may comprise simply a drive selection means and a retainer. The drive selection means pertains to any component or combination of components that are able to cause selective engagement or disengagement of the drive means from a cylinder when the cylinder is placed in a drive position in the grading machine. For example, the drive selection means may comprise any means that causes contact or separation between components of the drive system, such as belts or cogs, connected to the cylinder. Where drive wheels are present (to contact directly and drive the cylinder) the drive selection means may alternatively involve some mechanism to cause selective contact or separation of the drive wheels with the cylinder by movement of the drive wheels and the cylinder relative to one another (by movement of either the cylinder, or of the drive wheels, or of both).

The retainer of the device pertains to any means to hold any cylinder away from the drive means when disengaged therefrom (e.g. in the machine). For example the retainer may comprise some form of frame, cradle, or carriage of any type and configuration to contact the cylinder at one or multiple places, thereby to hold or cradle the cylinder in a position such that there is a lack of physical contact or a physical gap between the cylinder and the drive means. Regardless of the precise configuration of the retainer, the retainer further comprises some means to enable axial movement or displacement of the cylinder relative to the drive means, for example either along a path substantially parallel to the main axis of the cylinder, or along a curvilinear path that gives rise to at least some axial displacement of the cylinder from its driven position. To facilitate this movement of the cylinder, the retainer may comprise at least one roller and/or slider, or a plurality of rollers and/or sliders so that the cylinder can be rolled or slid either with the frame or over the frame relative to the grading machine, for axial movement or displacement of the cylinder between a 'drive position' (adjacent the drive means), and a 'change position' suitable for insertion or removal of the cylinder from the machine.

In selected embodiments the rollers and/or sliders of the retainer are upwardly oriented so that they may make direct contact with a lower half of a cylinder when held by the retainer, such that the curved surface of the cylinder rests upon the rollers and/or sliders, for said axial movement thereupon. In this way the curved surface of the cylinder rolls or slides over the rollers or sliders in a direction substantially in line with the axis of the cylinder and in line with the length of the cylinder. If rollers are present rather than sliders then the device may comprise a plurality of rollers, where each roller has an axis for rotation substantially perpendicular to a main axis of any cylinder held by the retainer, so that when disengaged from the drive means the cylinder can be supported by and rolled over the rollers in an axial direction in general alignment with its main axis. For example, the retainer may comprise at least two pairs of rollers each pair being spaced apart from other pairs. In this way the cylinder may be supported separate from the drive means by at least four rollers when disengaged from the drive means.

In further selected embodiments the device may further comprise a lever and/or cable linked to the drive selection means so that movement of the lever or cable causes the drive means to selectively engage and/or disengage from the cylinder. In this way the lever or cable may provide a physical operative link to transfer a mechanical force generated by a user of the device to the drive selection means such that the user may control whether or not the drive means is operatively engaged to drive rotation of the cylinder, from a distance remote (e.g. perhaps a few meters from) the drive means. For example, in selected embodiments discussed below, the grading machine may include a general enclosure to enclose most if not all of the other components of the machine. The invention encompasses the use of such an enclosure, optionally with an opening for insertion or removal of a cylinder therethrough. The opening may be selectively closable by a door or a removable access panel. Optionally, the door may be connected to a remaining body of the enclosure by any form of hinge device as will be known in the art. In selected embodiments the door may be linked to the lever and/or cable so that opening of the door, for example by movement about a hinge, causes the drive selection means to disengage the drive means from the cylinder, and closing the door causes the drive selection means to engage the drive means with the cylinder.

In further exemplary embodiments there is provided a machine for use with a grading cylinder of any type for separation or other processing of solid granular or particulate materials according to physical parameters of the component granules or particles. For example, the machine may comprise any device as described herein (typically comprising a drive selection means and a retainer) together with at least a drive means to drive rotation of a grading cylinder about its main axis when appropriately retained by the machine, wherein the drive means pertains to any component or components suitable to cause rotation of the cylinder, as described above.

Optionally the machine may further comprise an elongate enclosure for receiving therein a grading cylinder for rotation by the machine. The grading cylinder may be interchangeable for other types of cylinders with other selection or processing characteristics, or in specific embodiments the cylinder may form a component part of the machine. In selected embodiments the elongate enclosure accommodates a cylinder with the cylinder axis running generally parallel with the elongate sides of the enclosure. The enclosure thus may optionally include ends (or end walls) typically adjacent or near the ends of the cylinder retained in the enclosure, wherein at least one of the ends may comprise a door that is openable to remove a grading cylinder from, or insert a grading cylinder into, the machine by axial movement of the cylinder. The door may take any form known in the art, and be attached to the remainder of the enclosure via any form of attachment, hinge or opening device that is oriented in any direction. For example, the door may be attached via a hinge at the top, bottom, or one side of the door. Alternatively, the door may comprise two or more cooperating doors that together open to reveal an opening in the end of the enclosure suitable for passage therethrough of a cylinder.

Regardless of the precise configuration of the door, the door may in specific embodiments be connected directly or indirectly to the drive selection means and/or to the retainer for example via a physical link such as a lever or cable, such that movement of the door from a closed to an open position causes the drive selection means to disengage the drive means from any cylinder located within the enclosure. In this way, the mechanical force generated by the user to open and close the door of the enclosure may be transferred to the drive selection means to cause contact or separation between the drive means and the cylinder. Optionally, movement of the lever or cable may further result in axial movement of any cylinder present within the enclosure towards and optionally through said door, thereby to facilitate removal of the cylinder, if present, from the machine.

Still further exemplary embodiments provide for a plant, factory or other facility for separation of solid granular or particulate materials according to physical parameters of the component granules or particles. For example the facility may comprise: a plurality of machines as described herein, each comprising at least a drive means for a grading cylinder, as well as a device as described herein comprising at least a drive selection means and a retainer. The configuration of the device and machine of the present invention permits the machines to be placed in juxtaposition for retaining the grading cylinders such that their axes of rotation of generally parallel to one another. In addition, or alternative to juxtaposed grouping, at least two of the machines may be stacked one on top of the other. In other words, the machines of the present invention may be grouped in a plant or factory so that the only point of access to the machines (e.g. to insert, remove or exchange cylinders) is from one end of each machine. The device of the present invention, by permitting cylinder movement into and out of a grading machine by axial movement or displacement, presents significant advantages because it is no longer necessary to provide space to the side or above each grading machine for cylinder access and exchange. Referring once again to FIG. 1 it will be noted that the cylinder is accessed and removed from the grading machine from an elongate side of the machine, where as in other examples of the prior art the cylinder is accessed and removed from the top of a grading machine. In contrast, the present invention permits cylinder access and removal (or insertion) from a smaller end-wall of the machine. Thus a plurality of grading machines may be stacked, and the stacks brought into juxtaposition with one another, without limiting access to each individual machine for cylinder removal and machine servicing. Importantly, each grading cylinder is insertable into or removable from each stacked machine by axially rolling or sliding each grading cylinder to or from the drive position, optionally through an openable door in the end of each machine, if present. Optionally, any agitators, screw conveyors or lifting troughs where present may be retained in position within the grading machines even during insertion or removal of grading cylinders. Alternatively, where such agitators, screw conveyors or lifting troughs form integral components with the grading cylinders, such components may by inserted or removed from the grading machines together with the grading cylinders.

In further selected embodiments the invention provides a method for removal of a grading cylinder from a grading machine as described herein. For example, the method may comprise the steps of: disengaging, by way of the drive selection means, the cylinder from the drive means; holding, by way of the retainer, the cylinder away from the drive means; and axially rolling and/or sliding, by way of the rollers and/or sliders, the cylinder to said change position. Where a lever or cable is present (as discussed above) the step of disengaging may comprise moving a lever or cable connected to the drive selection means. Furthermore, where the retainer comprises a plurality of rollers mounted with an axis for rotation perpendicular to the main axis of the cylinder, then the step of holding comprises contacting the rollers directly with the curvilinear surface of the cylinder. Optionally, the step of axially rolling or sliding may comprise rolling the cylinder over the rollers, thereby to transfer the cylinder to the change position, suitable for removal of the cylinder from the grading machine.

In selected embodiments the grading machine of the invention is suitable for use with a cylinder and an agitator, auger, screw conveyor, liftings trough or other component to assist in sorting and/or separation of the material according to its width, thickness or length. As discussed, agitators or screw conveyors are typically positioned within the cylinder for co-axial rotation therewith during operation of the machine. The use of such additional components is well known in the art, as previously discussed.

The present invention encompasses machines and cylinders adapted for use with such screw conveyors, augers, agitators and the like to facilitate material sorting, separation, processing, and collection. However, in selected embodiments the machine includes components to cause the auger or similar device to rotate at a speed that is different to the speed of rotation of the cylinder (or at least the curved main body of the cylinder), and/or in a direction of rotation that is the same as or opposite to that of the cylinder (or at least the curved main body of the cylinder). The machine thus includes any form of belt or gearing mechanism, for example linked to the drive system, to drive the auger or similar device at a speed of rotation and/or a direction of rotation that is different from that of the cylinder. Preferably, the speed and direction of rotation of the cylinder and the auger (or similar device) is adjustable as required either prior to or during operation of the machine to optimize material sorting, separation, processing, or collection. For example, different types of granular or powdered materials may require a different set of parameters in terms of the operation of the grading machine, including custom or adjustable cylinder and auger/agitator drive speeds. Thus, selected embodiments the invention encompass machines in which the speed or direction of rotation of the cylinder can be different or adjusted relative to that of another rotating device rotating within the cylinder.

For example, in selected embodiments the grading machine of the invention includes a screw conveyor, wherein the screw conveyor is caused to rotate faster than the speed of rotation of an associated indented cylinder. This in turn conveys lifted product (i.e. liftings that have been lifted by an indented cylinder and collected in a liftings trough) faster, thus increasing the processing speed of the grading machine. In other embodiments, the grading machine comprises an agitator, and the agitator is caused to rotate faster than its associated perforated cylinder. This in turn causes more aggressive agitation of the material within the cylinder, and faster sorting of the material because the material is thrown against the perforated curved surface of the cylinder with a greater force. As will be more apparent from the foregoing discussion of the figures, selected grading machines of the invention include a drive system for separate control of the speed of the cylinder, and any agitator, screw conveyor, auger or other component co-axially mounted therein, wherein the drive system is located at an end of the cylinder opposite the cylinder removal end.

The invention will now be further described and illustrated with reference to the appended drawings (with the exception of FIG. 1), which are merely representative of selected embodiments and examples of the invention, and are in no way intended to limit the scope of the invention as herein described and claimed.

Figure 2A:
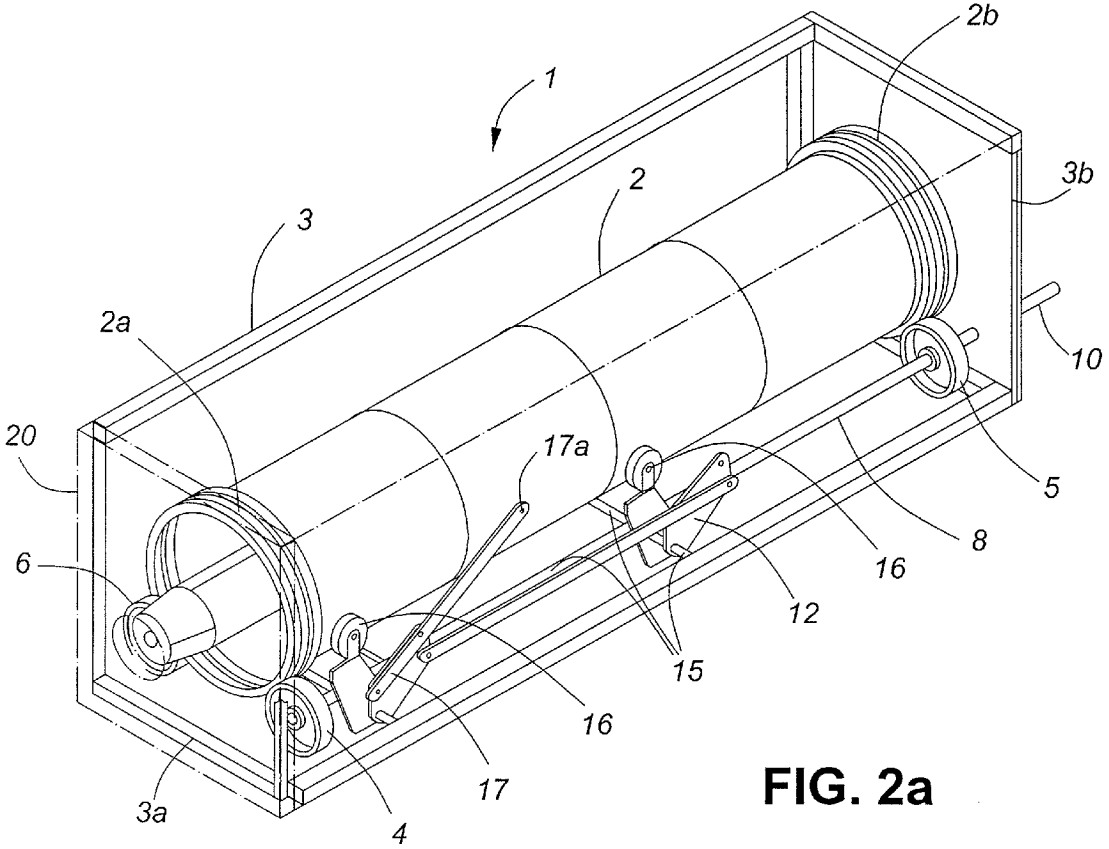
FIG. 2*a* illustrates a front side perspective view of a grading machine, which incorporates a grading cylinder and a device for cylinder insertion or removal, wherein the cylinder is ready to be driven by drive wheels.

Turning first to FIG. 2*a*, there is shown a grading machine 1 for retaining therein a grading cylinder 2, the grading machine comprising an enclosure 3 shown with cut-away or transparent front, top and side walls to illustrate the internal features of the machine. The machine further comprises drive wheels 4, 5, 6, with drive wheels 4 and 6 forming an opposing pair, and drive wheel 5 forming an opposing pair with another drive wheel not shown in FIG. 2 due to the position if cylinder 2. Drive wheels 4 and 5 are connected via drive shaft 8. Another drive shaft (not shown) connects drive wheel 6 to the fourth drive wheel (not shown) that opposes drive wheel 5. As illustrated in FIG. 2*a* the machine retains cylinder 2 in a drive position, in which drive wheels 4, 5, 6 make direct contact with ends 2*a*, 2*b* of the cylinder 2. Rotation of drive wheels 4, 5 is powered from end 10 of drive shaft 8, such that powered rotation of the drive wheels 4, 5 causes rotation of cylinder 2 about its main axis. Further torque is provided to the cylinder by drive wheel 6 and the additional opposing drive wheel (not shown). Positive contact between the drive wheels and the cylinder (i.e. contact without slippage) may be maintained by locking the cylinder and the drive wheels in position relative to one another. Alternatively, the cylinder may simply rest upon the drive wheels, such that the weight of the cylinder upon the drive wheels is sufficient for efficient transfer of rotational kinetic energy from the drive wheels to the cylinder with minimal slippage of the drive wheels. Regardless, any granular material (not shown) retained within cylinder 2 is moved about or thrown about within cylinder 2 due at least to the contact of the granules or particles with the curved side of the cylinder.

An example device of the invention is shown generally in FIG. 2*a* to include a drive selection means to selectively separate cylinder 2 from drive wheels 4, 5, 6, as well as a retainer to retain the cylinder away from the drive wheels once separated from the drive wheels. In the embodiment illustrated, the drive selection means comprises offset pivot joints 12, connected via strut 14, and including lever 17. The retainer includes rollers 16 themselves mounted to frame elements that together form frame 15. In FIG. 2*a* the frame 15 and mounted rollers 16 are arranged such that they are spatially separated from the cylinder whilst in the drive position.

Figure 2B:
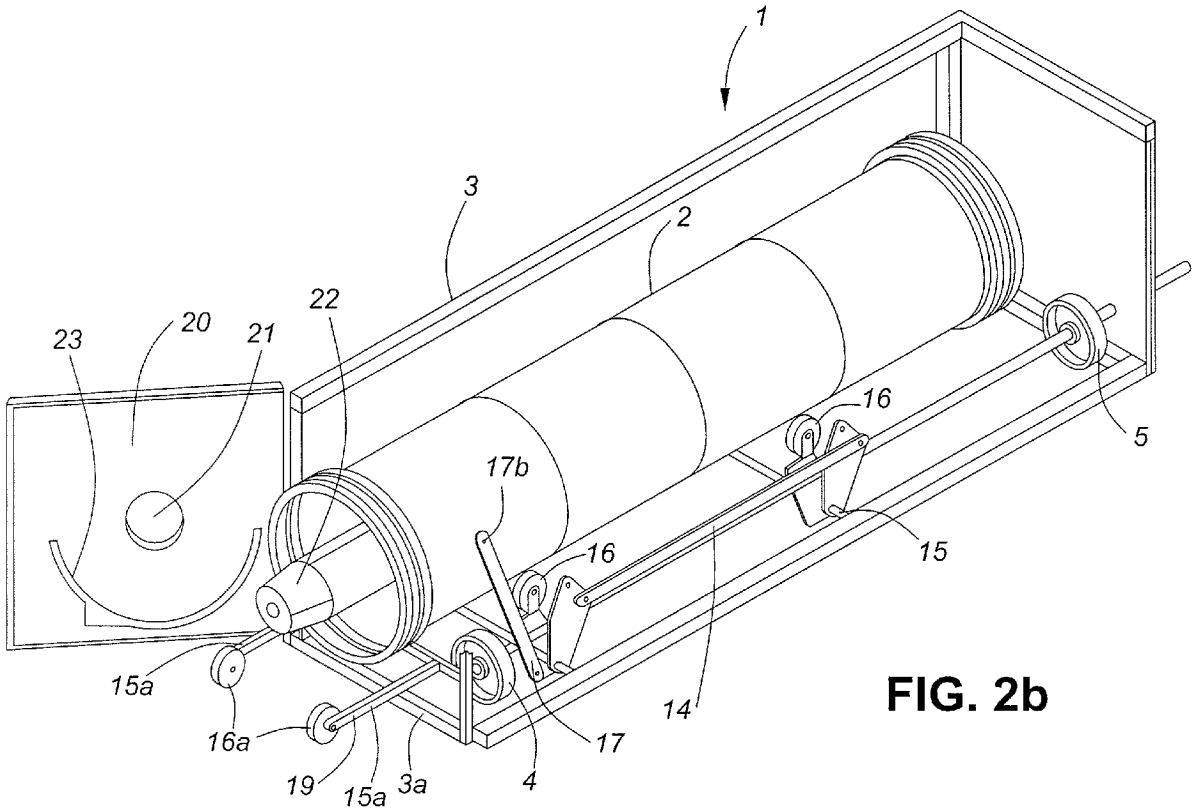
FIG. 2*b* illustrates a front side perspective view of a grading machine, which incorporates a grading cylinder and a device for cylinder insertion or removal, wherein the cylinder is ready to be removed from the grading machine.
Figure 2C:
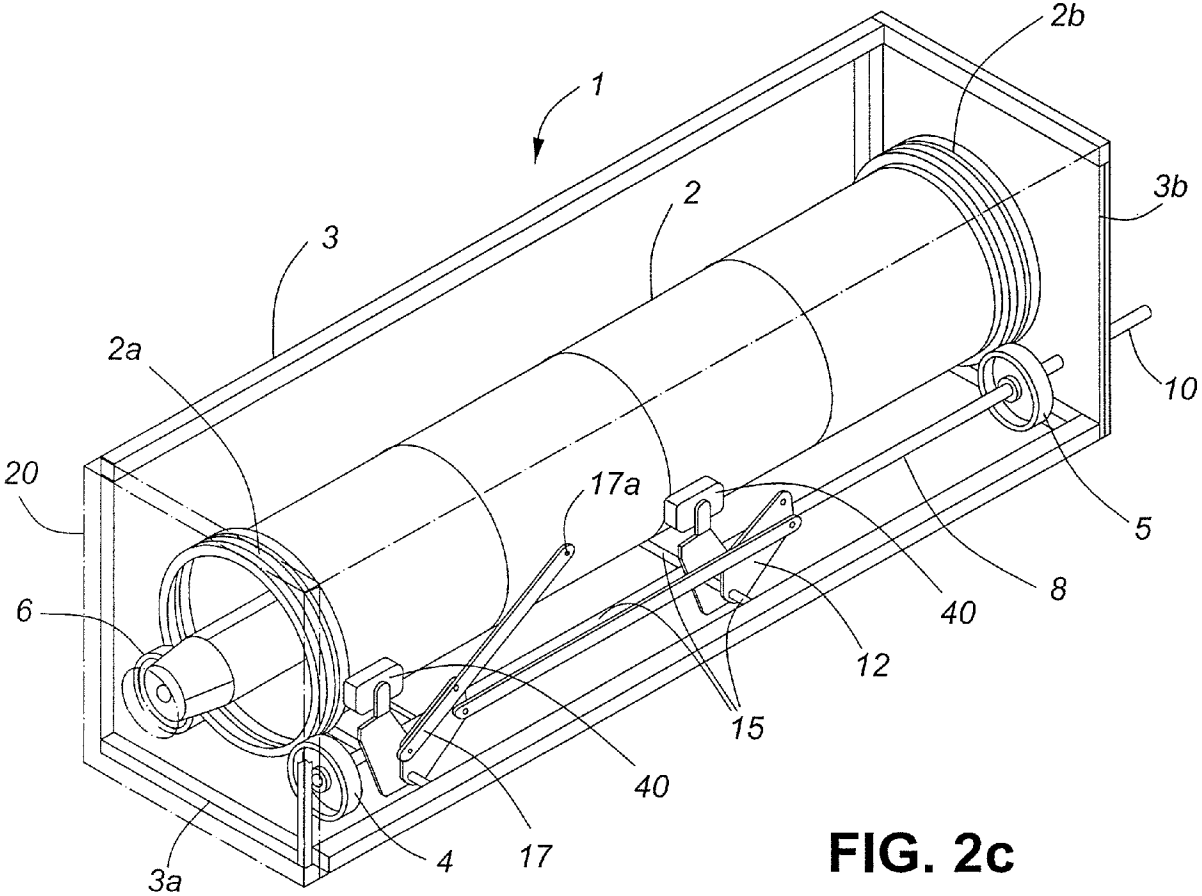
FIG. 2*c* illustrates a front side perspective view of a grading machine identical to FIG. 2*a* with the exception that rollers 16 are replaced by sliders 40.
Figure 2D:
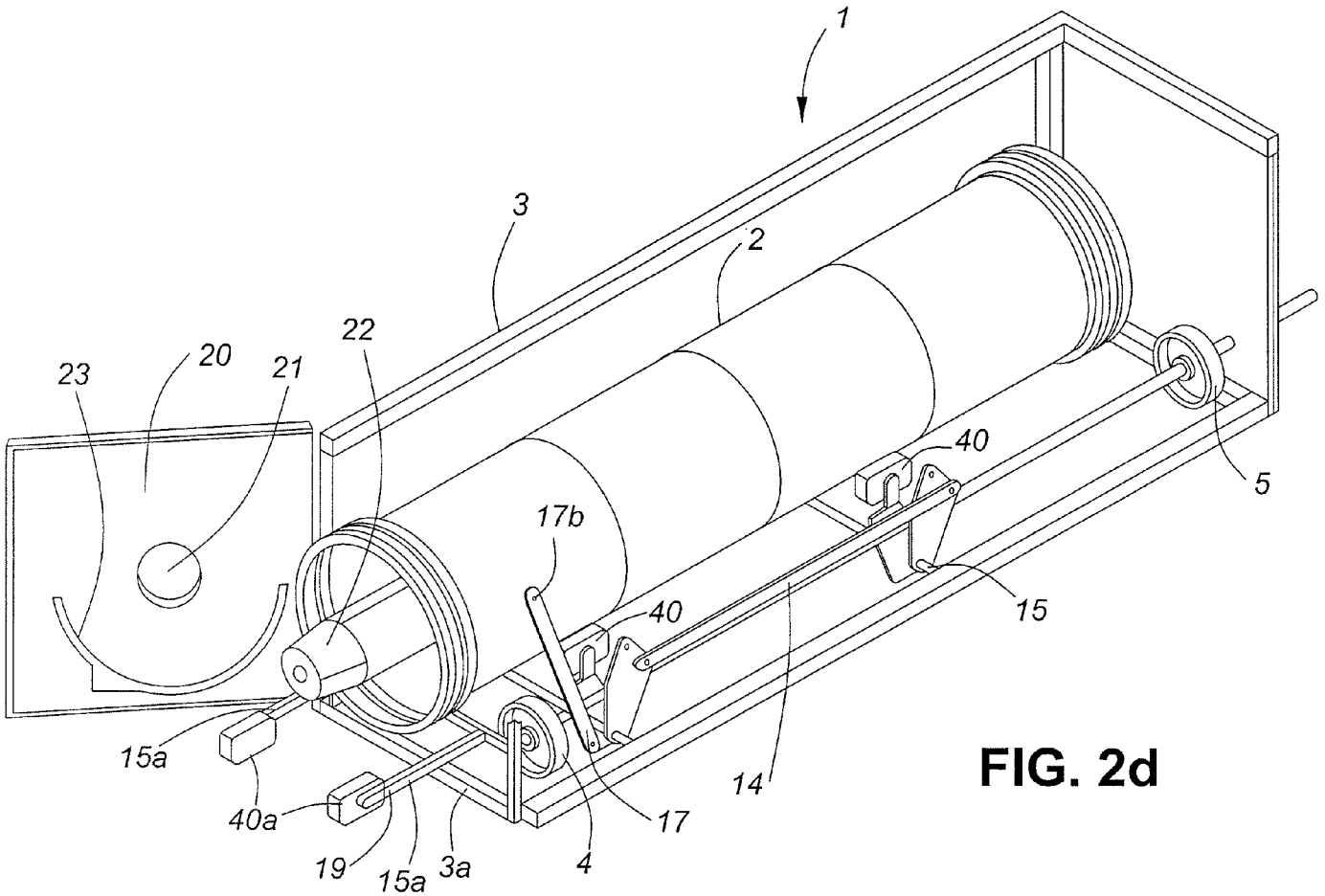
FIG. 2*d* illustrates a front side perspective view of a grading machine identical to that shown in FIG. 2*b* with the exception that rollers 16 are replaced with sliders 40.

FIG. 2*b* illustrates the same grading machine and other components as shown in FIG. 2*a*, except that the components have been moved such that the grading cylinder 2 is no longer in a position suitable to be driven by drive wheels 4, 5, 6 because the grading cylinder 2 is physically separated (as illustrated the cylinder has been lifted away) from the drive wheels 4, 5, 6. In effect, the cylinder has been moved from a position ready to be driven by or rotated by the drive wheels, to position ready to be removed from the grading machine. This is achieved by a user pulling upon lever 17 such that it moves from position 17*a* (FIG. 2*a*) towards position 17*b* (FIG. 2*b*). This in turn causes rotation of offset pivot joints 12 (connected via strut 14) so that the retainer (comprising frame 15 together with mounted rollers 16) is displaced so that the roller wheels contact directly and bear upon the curved surface of cylinder 2. Further movement of lever 17 causes the roller wheels to impart such a force upon the cylinder that the cylinder is caused to be lifted away from contact with the drive wheels and into the position shown in FIG. 2*b*. Each roller 16 imparts a similar force to the cylinder 2 because the rollers are affixed to frame 15, and the entire frame moves the rollers 16 at the same time.

As shown in FIG. 2*b*, cylinder 2 now rests upon rollers 16 instead of drive wheels 4, 5, 6. The roller wheels are freely rotatable, and thus cylinder 2 can be caused to move axially in the same general direction of movement as lever 17 by rolling over the roller wheels, the curved surface of the cylinder retaining contact with all rollers at least during the initial movement of the cylinder. FIG. 2*b* shows an optional feature by way of additional rollers 16*a* shown at the ends of frame extensions 15*a*. These additional rollers are provided so that as the cylinder is rolled in an axial direction out of the machine, the cylinder can be rolled onto rollers 16*a* before loss of contact with rollers 16 located at the rear end of the machine. In this way, the cylinder maintains contact with at least four rollers at it moves from near the drive position until the cylinder is rolled out of the machine.

Also shown in FIGS. 2*a* and 2*b* is door 20, which forms part of enclosure 3. In the drive position, with the drive wheels 4, 5, 6 in contact with cylinder 2, the door 20 is in a closed position (FIG. 2*a*). Door 20 moves from a closed to an open position (FIG. 2*b*) about a hinge (not shown) so that the cylinder 2 can be accessed, and rolled out of the enclosure for servicing or replacement. Optionally door 20 may be physically connected to the drive selection means, for example by a linkage with lever 17 and/or via a cable or other linkage (not shown) such that opening door 17 causes the drive selection means to disengage the drive wheels from the cylinder, and move the cylinder or drive wheels thus to separate the cylinder from contact with the drive wheels, so that the cylinder is in a position ready to be rolled out of the machine. Optionally, the door may be linked to the cylinder itself (or the retainer), such that opening the door not only causes disengagement of the cylinder and the drive wheels, but also movement of the cylinder once held or retained on the rollers.

FIG. 2*b* illustrates further optional features with regard to the door. These include orifice 21 to hold or retain portion 22 of the cylinder (which may form a part of a co-axial screw conveyor or agitator—not shown) thus to provide means to support the cylinder at the door-end of the enclosure for axial rotation of the cylinder during operation of the machine. Also shown is tailing catch tray 23 to catch or retaining any granular material moving about the inside of the cylinder during operation, which migrates to a position adjacent the door and to catch tailings.

Figure 3:
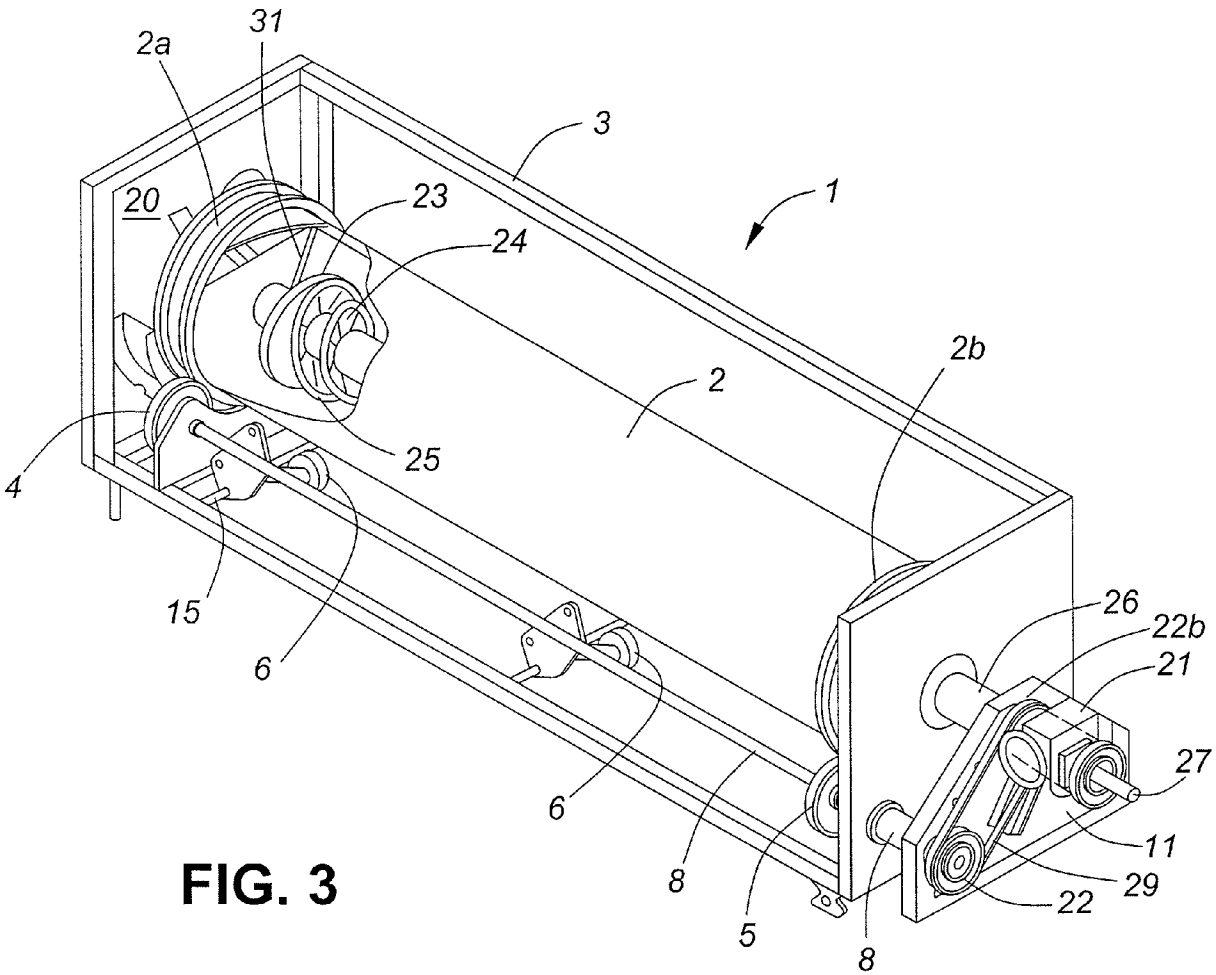
FIG. 3 illustrates a rear side perspective view of a grading machine, which incorporates a grading cylinder and a device for cylinder insertion or removal, wherein the cylinder is ready to be driven by drive wheels.

Turning now to FIG. 3, there is shown the same grading as shown in FIGS. 2*a* and 2*b*, but from an alternative perspective, with additional features shown. In this embodiment, grading cylinder 2 is an indented cylinder for separating particulate matter according to the length of the particles (see above). The grading machine is shown with cylinder 2 in the drive position with contact between drive wheels 4 and 5 with ends 2*a* and 2*b* of cylinder 2 respectively. Perhaps shown more clearly than in FIG. 2*a*, rollers 6 mounted to frame 15 are separate from cylinder 2 so that they do not impede rotation of the cylinder during operation of the grading machine. A portion of the cylinder is shown cut away to reveal liftings trough 31 (better illustrated in FIGS. 4*a* and 4*b*—see below) for catching liftings that are lifted by indented cylinder 2 when the lifted particles are retained in the indentations of the cylinder. Also illustrated is screw conveyor 24, which includes shaft 26 extending out of the grading machine at the end opposite door 20. Screw conveyor 24 includes screw-like rib 23 such that lifted material deposited into or otherwise retained by liftings trough 31 is caused to be conveyed to one end of the cylinder for collection. Regardless, indented cylinder 2, liftings trough 31 and screw conveyor 24 are shown for illustrative purposes only, and may be absent or replaced by a perforated cylinder together with another co-axially mounted device such as an agitator of a type that is known in the art.

FIG. 3 illustrates one means by which cylinder 2 can be caused to rotate at a speed of rotation that is different (i.e. greater than or less than) a speed of rotation of the screw conveyor (other other device) co-axially mounted for rotation within the cylinder. As shown, the shaft 26 of the screw conveyor 24 is driven directly from end 27 thereof such that the degree of power applied to the shaft determines the speed of rotation of the screw conveyor within the cylinder. The shaft 26 extends through a rigidly mounted drive plate 11. End 28 of drive shaft 8 (connecting drive wheels 4 and 5) also extends through drive plate 11. Another drive shaft (not shown) connecting drive wheel 6 and another drive wheel (not shown) may also extend through drive plate 11 on an opposite side to shaft 26 to drive shaft 8. Belt or chain 29 together with pulley 30 (located at end 28 of drive shaft 8) provides indirect drive to power rotation of drive shaft 8. Again, a similar belt or chain drive arrangement may be provided from shaft 26 to the other drive shaft for the other drive wheels (not shown). By changing the ratios on the pulleys, chains or belts the speed of rotation of drive shaft 8 may be adjusted relative to the speed of rotation of shaft 26, thereby to cause the cylinder to rotate faster or slower relative to the screw conveyor.

Whilst FIG. 3 presents one embodiment for selective control of the relative speeds of the cylinder and screw conveyor (or other device) the invention encompasses any grading machine that permits selective control of the rotational speeds of the cylinder and screw conveyor (or other device). Indeed, many alternative systems, such as those involving gearing, cogged wheels, or other mechanical devices may be employed instead of the arrangement shown in FIG. 3. Moreover, the screw conveyor or other device may be powered separately from the cylinder from a different power source. The invention, at least in selected embodiments, encompasses the realization that significant processing advantages may be obtained by rotating the cylinder at a speed and/or in a direction that differs from the speed and/or direction of rotation for the screw conveyor, agitator or other conveyor mounted for rotation within the cylinder. In selected embodiments, the speed of the cylinder relative to the screw conveyor, agitator or other device may be adjustable either prior to or during operation of the machine. In further embodiments that relative speeds of rotation may be adjustable automatically, for example according to the material to be processed, the desired separation of the material, the quantity of the material present or the cylinder being used.

Figure 4A:
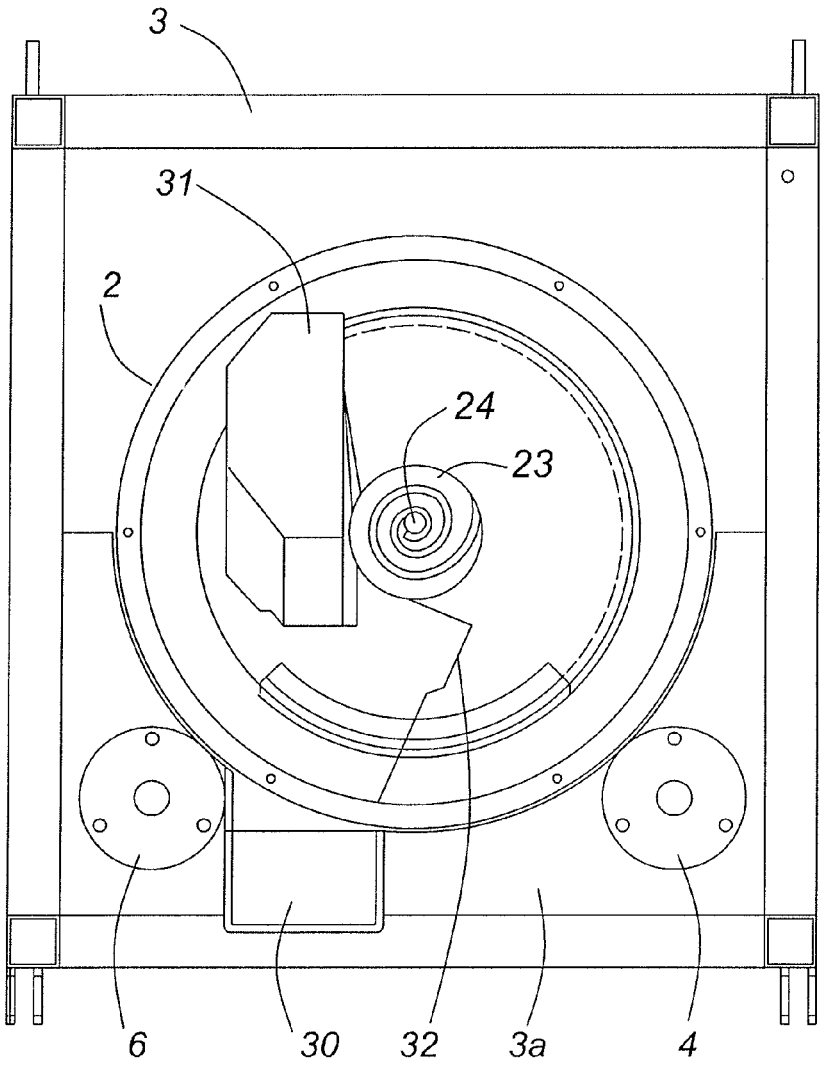
FIG. 4*a* illustrates a front view of a grading machine to illustrate inlets and outlets for the granular material, with the cylinder ready to be driven by the drive wheels.
Figure 4B:
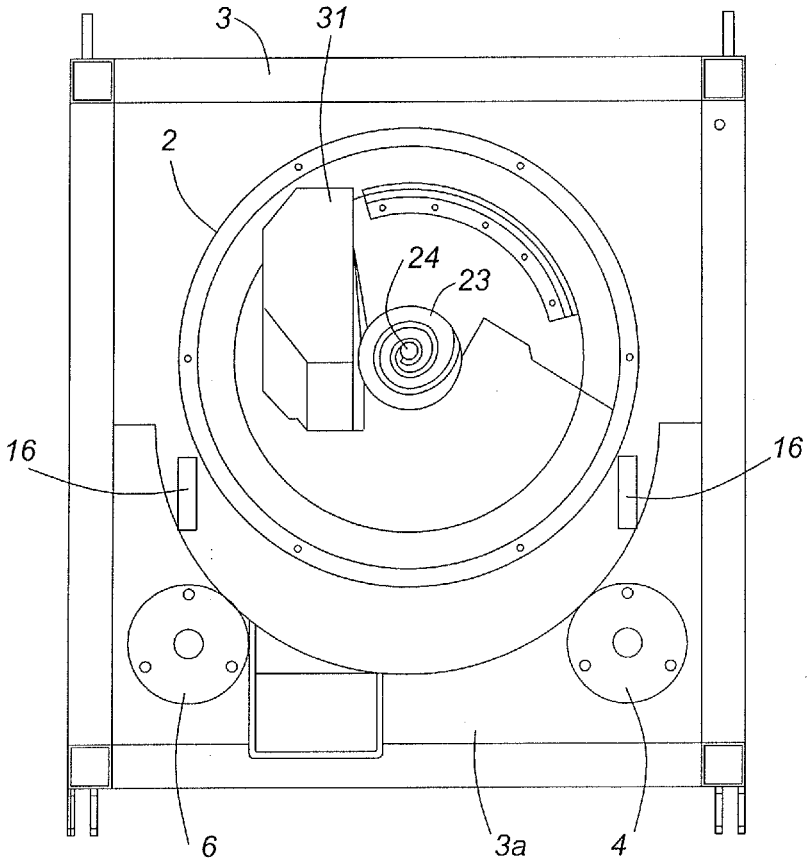
FIG. 4*b* illustrates a front view of a grading machine to illustrate inlets and outlets for the granular material, with the cylinder ready to be removed from the grading machine.

Further clarification of the operation of the grading machine is provided with reference to FIGS. 4*a* and 4*b*. These Figures again illustrate the same grading machine as FIGS. 2*a* and 2*b*, this time from an end-on viewpoint. FIG. 4*a* illustrates a grading cylinder in a drive position resting upon, or with direct contact with, opposing drive wheels 4 and 6 such that driven rotation of the drive wheels causes rotation of the cylinder. Screw conveyor 24 is also shown mounted co-axially within the cylinder. Also illustrated is tailing flow retarder 32, which may be located at both or either end of the cylinder to retard tailing of the granular material that moves to the cylinder ends, for example via the screw conveyor or agitator. Liftings trough 31 is also shown to catch particulate material that has been lifted by indented cylinder 2. The liftings trough is only partially shown so that the screw conveyor 24 can be seen. Tailing discharge spout 30 receives tailings that exit the cylinder.

FIG. 4*b* further illustrates the same grading machine from the same viewpoint as FIG. 4*a*, except that cylinder 2 has been lifted into an exchange position ready to be rolled out of the grading machine. The cylinder rests upon rollers 16 (the frame 15 is not shown for simplicity) instead of drive wheels 4, 6, which are now spatially separated from the cylinder so that they do not impede its removal from the machine.

In selected embodiments, the grading cylinder and/or associated components (such as a liftings trough or screw conveyor), may be mounted in a grading machine at one end opposite the removal end of the cylinder (e.g. opposite the door-end of the grading machine). This is often desired so that the cylinder can be removed by axial movement or displacement from the machine. Features of the grading machine at the door end may help to retain the cylinder and/or associated components in place during operation and/or removal of the cylinder (e.g. see orifice 21 in door 20 in FIG. 2, and discussion thereof). However, at times the cylinder or other components may be retained in the machine at only one end opposite the door end. Therefore, the cylinder or other components may be subject to significant cantilever forces. To combat such forces, the components of the grading machine opposite the door end may be specially reinforced thereby to avoid sag or similar downward displacement that could affect proper operation of the machine. For example, an end of the enclosure for the machine opposite the door end may include a reinforced steel plate along with heavy wall pipe incorporating heavy duty bearings to support the cantilevered load or the cylinder and/or screw conveyor/agitator and/or lifting trough assembly when mounted thereto. Further, an adjustable torque arm may also be present for additional support of the cantilevered load.

Thus in selected embodiments there is provided a grading machine in which a screw conveyor/liftings trough assembly or an agitator is retained or suspended from one end within the machine. During operation of the machine, rotation of the screw conveyor or agitator is driven from that end as described herein. This leaves the end of the screw conveyor or agitator opposite the driven end substantially free from the encumbrances of drive systems. This in turn facilitates the provision of a grading machine in which grading cylinders may be inserted into or removed from the grading machine by axial movement thereof, whilst retaining any screw conveyor/liftings trough or agitator in position within the machine, and without need to decouple the screw conveyor or agitator from the machine at its driven end, or from its drive mechanism. In accordance with the teachings herein, in selected embodiments the screw conveyor or agitator may be driven at a speed and direction independent from that of the cylinder (or at least the main curved body of the cylinder) by independent drive mechanisms or in accordance with the teachings herein.

Whilst the devices, grading machines, and methods of the invention have been described with reference to particular embodiments, the invention is not limited to those embodiments. Further embodiments that are within or extend beyond the scope of the present description and claims are intended to fall within the scope of the invention.

The invention claimed is:

1. A device for insertion or removal of a grading cylinder into or from a grading machine that includes drive means to drive rotation of the grading cylinder about its central axis, the device comprising:

(a) drive selection means to selectively engage the drive means with, or selectively disengage the drive means from, the grading cylinder;

(b) a retainer to hold the cylinder away from the drive means when disengaged therefrom, the retainer comprising at least one roller and/or slider for axial movement or displacement of the cylinder along its central axis between a drive position for the cylinder adjacent the drive means, and a change position for the cylinder suitable for insertion or removal of the cylinder from the machine;

wherein the retainer comprises a frame, the at least one roller and/or slider being mounted to the frame and upwardly oriented to make direct contact with a lower half of the cylinder when held by the retainer away from the drive means, such that the cylinder rests upon the at least one roller and/or slider during said axial movement of the cylinder along its central axis from said drive position to said change position.

2. The device of claim 1, wherein the device comprises a plurality of rollers, each having an axis substantially perpendicular to a central axis of any cylinder held by the retainer, so that when disengaged from the drive means the cylinder can roll over the rollers in a direction generally parallel to its central axis.

3. The device of claim 2, wherein the retainer comprises at least two opposing pairs of rollers to contact and hold the cylinder away from the drive means by at least four rollers when the cylinder is disengaged from the drive means.

4. The device of claim 1, wherein the device further comprises a lever or cable linked to the drive selection means so that movement of the lever or cable causes the drive means to selectively engage and/or disengage from the cylinder.

5. A grading machine for separation of solid granular or particulate materials according to physical parameters of the component granules or particles, the machine comprising:

the device according to claim 1; and the drive means to drive rotation of the grading cylinder about its central axis when retained by the machine in the drive position.

6. The machine of claim 5, further comprising an elongate enclosure for receiving therein the grading cylinder for rotation by the machine.

7. The machine of claim 6, wherein the elongate enclosure includes ends, at least one of which comprises a door that is openable to remove the grading cylinder from, or insert the grading cylinder into, the machine by axial movement of the cylinder.

8. The machine of claim 7, wherein the door is connected directly or indirectly to the drive selection means by a lever or cable, such that opening the door causes movement of the lever or cable to cause said drive selection means to disengage the drive means from any cylinder located within the enclosure.

9. The machine of claim 8, wherein movement of the lever or cable further causes axial movement of any cylinder present within the enclosure towards and optionally through said door, thereby to facilitate removal of the cylinder, if present, from the machine.

10. A facility for separation of solid granular or particulate materials according to physical parameters of the component granules or particles, the facility comprising:

a plurality of grading machines according to claim 5, at least two of the machines being stacked one on top of the other, or juxtaposed one beside the other.

11. The facility of claim 10, wherein one grading machine feeds output material to an input of another grading machine.

12. A method for removal of a grading cylinder from a grading machine, wherein the grading machine comprises:

a device for insertion or removal of a grading cylinder into or from a grading machine that includes drive means to drive rotation of the grading cylinder about its central axis, the device comprising:

(a) drive selection means to selectively engage the drive means with, or selectively disengage the drive means from, the grading cylinder;

(b) a retainer to hold the cylinder away from the drive means when disengaged therefrom, the retainer comprising at least one roller and/or slider for axial movement or displacement of the cylinder along its central axis between a drive position for the cylinder adjacent the drive means, and a change position for the cylinder suitable for insertion or removal of the cylinder from the machine;

wherein the retainer comprises a frame, the at least one roller and/or slider being mounted to the frame and upwardly oriented to make direct contact with a lower half of the cylinder when held by the retainer away from the drive means, such that the cylinder rests upon the roller(s) and/or slider(s) at least one roller and/or slider during said axial movement of the cylinder along its central axis from said drive position to said change position; and the drive means driving rotation of the grading cylinder about its central axis when retained by the machine in the drive positions;

the method comprising the steps of:

a. disengaging, by way of the drive selection means, the cylinder from the drive means;

b. holding, by way of the retainer, the cylinder away from the drive means;

c. axially rolling and/or sliding, by way of said at least one roller and/or slider, the cylinder to said change position.

13. The method of claim 12, wherein the step of disengaging comprises moving a lever or cable connected to the drive selection means.

14. The method of claim 12, wherein the retainer comprises a plurality of rollers mounted with an axis for rotation perpendicular to the central axis of the cylinder, and the step of holding comprises contacting the rollers directly with the curvilinear surface of the cylinder.

15. The method of claim 14, wherein the step of axially rolling or sliding comprises rolling the cylinder over said rollers.

* * * * *

UNITED STATES PATENT AND TRADEMARK OFFICE

CERTIFICATE OF CORRECTION

PATENT NO. : 9,126,233 B2
APPLICATION NO. : 13/512223
DATED : September 8, 2015
INVENTOR(S) : Marcel Sierens et al.

It is certified that error appears in the above-identified patent and that said Letters Patent is hereby corrected as shown below:

IN THE CLAIMS

In column 16, at line 45, cancel the words "the roller(s) and/or slider(s)".

Signed and Sealed this
Fifteenth Day of March, 2016

Michelle K. Lee

Michelle K. Lee
*Director of the United States Patent and Trademark Office*